US006885832B2

(12) United States Patent
Osada

(10) Patent No.: US 6,885,832 B2
(45) Date of Patent: Apr. 26, 2005

(54) IMAGE FORMING APPARATUS HAVING SPEED-CHANGEABLE IMAGE BEARING BODY

(75) Inventor: Hikaru Osada, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/086,735

(22) Filed: Mar. 4, 2002

(65) Prior Publication Data

US 2002/0164173 A1 Nov. 7, 2002

(30) Foreign Application Priority Data

Mar. 5, 2001 (JP) ..... 2001/060352

(51) Int. Cl.[7] ..... G03G 15/00
(52) U.S. Cl. ..... 399/45
(58) Field of Search ..... 399/45, 86

(56) References Cited

U.S. PATENT DOCUMENTS

| | | | | |
|---|---|---|---|---|
| 4,970,219 A | | 11/1990 | Effland et al. | 514/339 |
| 5,148,226 A | | 9/1992 | Setoriyama et al. | 355/290 |
| 5,149,941 A | | 9/1992 | Hirabayashi et al. | 219/216 |
| 5,210,579 A | | 5/1993 | Setoriyama et al. | 355/285 |
| 5,512,927 A | * | 4/1996 | Okamoto | 347/129 |
| 5,525,775 A | | 6/1996 | Setoriyama et al. | 219/216 |
| 5,819,149 A | | 10/1998 | Watanabe et al. | 399/330 |

FOREIGN PATENT DOCUMENTS

| | | | |
|---|---|---|---|
| JP | 63-313182 | | 12/1988 |
| JP | 1-193885 | * | 8/1989 |
| JP | 2-157878 | | 6/1990 |
| JP | 4-44075 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 7-209933 | * | 8/1995 |
| JP | 07325442 A | * | 12/1995 ..... G03G/15/00 |
| JP | 9-319282 | | 12/1997 |
| JP | 10-340012 | * | 12/1998 |
| JP | 4-44076 | | 2/1999 |

OTHER PUBLICATIONS

Computer translation of JP 209933A.*

* cited by examiner

*Primary Examiner*—Quana Grainger
(74) *Attorney, Agent, or Firm*—Fitzpatrick, Cella, Harper & Scinto

(57) ABSTRACT

In an image forming apparatus using a pressuring roller, a carrying speed of the recording paper in the fixing nip part is dominated by a diameter of the pressing roller. Therefore, there is caused a change of speed in that, compared with a carrying speed for a initial diameter of the pressing roller when the pressing roller is not heated at the beginning of the fixing operation, the carrying speed at the fixing nip part is increased after performing the fixing operation continuously because the pressing roller is heated by the heating member so that the outside diameter is increased than the initial diameter.

15 Claims, 6 Drawing Sheets

IMAGE FORMING APPARATUS HAVING SPEED-CHANGEABLE IMAGE BEARING BODY

BACKGROUND OF THE INVENTION

1. Field of the Invention

The present invention relates to an image forming apparatus such as a duplicator or printer using a recording technique of an electrophotography system or electrostatic recording system, and more particularly to an image forming apparatus having a speed-changeable image bearing body.

2. Related Background Art

A laser printer using a transferring electrophotography process is taken as an example for the sake of convenience.

The above printer rotates an electrophotography photosensitive body (hereinafter, referred to as "photosensitive drum"), which is generally configured as a rotating drum, at a predetermined circumferential speed (process speed), charges a surface of the rotating photosensitive drum by a charging means to predetermined polarity and electric potential, and scans the charged surface to be exposed with a laser light. The laser light is modulated corresponding to a time-series, electric, digital, pixel signal of a purposed image information output from a laser scanner unit, so as to form an electrostatic latent image corresponding to the purposed image information on the surface of the rotating photosensitive drum. This electrostatic latent image is developed into a toner image by a developing means, and this toner image is transferred by a transferring means on a recording material (hereinafter, referred to as "recording paper") fed from a feeding unit to the transferring unit of the rotating photosensitive drum at predetermined timing. And, the recording paper on which the toner image (unfixed image) is transferred is introduced to a fixing means so as to fix the toner image on the recording paper as a permanent, fixed image to be output as an image forming material.

Conventionally, a roller heating method as shown in FIG. 9 is generally used for the fixing means (fixing unit or fixing machine). Reference numeral 20 denotes a rotation fixing roller acting as a heating member, in which a halogen heater 21 heats from inside of the roller having a heatproof releasing layer such as PFA formed on a surface of a core metal such as aluminum in a hollow cylindrical shape, and the roller is maintained to a predetermined temperature by regulating ON/OFF operation of the heater 21 with a control circuit not shown based on a temperature detected by a temperature detecting element 22. By introducing and carrying a recording material P on which an unfixed toner image T is laid on a fixing nip part N, which is a compressing nip part with a pressing roller as a pressing member compressed to the fixing roller 20, the toner image T is melted by heat of the fixing roller 20 so to be heat-fixed (stuck) on the recording paper surface On the other hand, as for the fixing device using the roller heating manner as described above, there is proposed a fixing device using a film heating manner (a heat-fixing device) characterized in that a power consumption is low in operation and a first print time, which is a time required from receiving a print signal till discharging a first piece of paper, is short, and disclosed in Japanese Patent Application Laid-Open No. 63-313182, Japanese Patent Application Laid-Open No. 2-157878 and so on. A schematic sectional view of the fixing device using the film heating manner is shown in FIG. 10.

This fixing device includes a heating member 30 having a heating body 32, a temperature detecting element 33 for detecting temperature of the heating body 32 and a heating body support 35 for supporting the heating body 32, and a pressing (pressuring) roller 36 interposed between the heating body 32 of the heating member 30 and a heat-resisting film 34, and introduces and carries a recording material P on which an unfixed toner image T is carried between the film and the pressing roller 36 of the fixing nip N acting as a compressing nip unit between the heating member 30 and the pressing roller 36 so that the toner image T is melted by the heat of the heating body 32 interposed by the film 34 so to be heat-fixed (stuck) to the recording material surface.

By using this film heating manner, it is possible to efficiently endow heat to the recording material P and fix the toner T with low power consumption because the thermal capacity of the whole fixing apparatus is low and the recording material P is faced with the heating body 32 only through the heat-resisting film 34. Furthermore, it is possible to operate the fixing apparatus rapid owing to the lower thermal capacity, and it is also possible to restrain power consumption and increase of inner temperature during not printing because it does not need to maintain residual heat as like the fixing apparatus using the roller heating manner.

In the above fixing apparatus using the film heating manner, a power source is commonly installed to the pressing roller 36 acting as a pressing member to drive the pressing roller 36 to rotate so that the heat-resisting film 34 acting as a moving body of the heating member 30 is driven, and the recording paper P introduced to the fixing nip part N is provided with carrying force from the rotation force of the pressing roller 36 so as to interposably carry the fixing nip part N together with the film 34. (The pressing roller driving method, disclosed in Japanese Patent Application Laid-Open No. 4-44075 to 44083, 204980 to 204984 and so on).

In case of the above pressing roller driving manner, because a carrying speed of the recording paper P in the fixing nip part N is dominated by a diameter of the pressing roller 36, there is caused a change of speed in that, compared with a carrying speed for a diameter of the pressing roller when the pressing roller 36 is not heated at the beginning of the fixing operation (an initial diameter), the carrying speed at the fixing nip part N is increased after performing the fixing operation continuously because the pressing roller 36 is heated by the heating member 30 and therefore thermally expanded so that the outside diameter is increased than the initial diameter.

For that reason, after executing the recording operation continuously, the recording paper carrying speed at the fixing nip part N of the fixing apparatus becomes higher than the recording paper carrying speed (process speed) at the transferring unit (image forming unit), thus creating a difference in speed between them. If the recording paper P is carried through the transferring unit at a predetermined process speed and passes the transferring unit while receiving the toner image as it is being transferred and a leading edge of the recording paper reaches the fixing nip part N of the fixing apparatus and is then interposed at the fixing nip part, in the case that the recording paper is ranged over the transferring unit and the fixing nip part N, this recording paper is carried at a recording paper carrying speed of the fixing nip, which is greater than the recording paper carrying speed of the transferring unit, or the predetermined process speed.

Therefore, at the point that the leading edge of the recording paper reaches the fixing nip part N of the fixing apparatus, because the recording paper is carried while being drawn at the recording paper carrying speed of the fixing nip part N of the fixing apparatus, which is higher than the recording paper carrying speed of the transferring unit, namely the predetermined process speed, the toner image (recording image) not transferred to the recording paper is stretched in a recording paper carrying direction, thus elongating the image. In some cases, a rear end of the image is deviated and lost from a rear end of the recording paper due to the image elongation.

To solve this problem, there is proposed an image forming apparatus to prevent the image elongation by changing the rotational speed of the photosensitive drum based on the successive recording paper number or the successive recording time, as disclosed in Japanese Patent Application Laid-Open No. 9-319282 (U.S. Pat. No. 5,819,149).

SUMMARY OF THE INVENTION

The present invention has further developed the technique of restraining the image elongation as above, and an object of the invention is to provide an image forming apparatus which may restrain the image elongation regardless of the kind of recording material.

Another object of the present invention is to provide an image forming apparatus which may restrain the image elongation regardless of the average amount of the recording materials.

In order to accomplish the above object, the present invention provides an image bearing member, a transferring means for transferring an image formed on the image bearing member to a recording material; a fixing means for fixing by heat the image transferred on the recording material to the recording material, the fixing means having a carrying member (conveying member) to carry (convey) the recording material; and a speed setting means for setting a moving speed of the image bearing member depending on the kind of the recording material.

In order to accomplish another object, the present invention provides an image bearing member, a transferring means for transferring an image formed on the image bearing member to a recording material; and a fixing means for fixing by heat the image transferred on the recording material to the recording material, the fixing means having a carrying member (conveying member) to carry (convey) the recording material, wherein a moving speed of said image bearing member when using a recording material of which a basic weight is a first value is slower than a moving speed of said image bearing member when using a recording material of which a basic weight is a second value greater than the first value.

These and other features and aspects of the present invention will become better understood with regard to the following description for embodiments of the present invention with reference to the following accompanying drawings.

BRIEF DESCRIPTION OF THE DRAWINGS

DETAILED DESCRIPTION OF THE PREFERRED EMBODIMENTS (1) Image Forming Apparatus FIG. 1 is a schematic view showing an example of an image forming apparatus. The image forming apparatus of this embodiment is a laser printer 100 using an electrophotography process.

Figure 1:
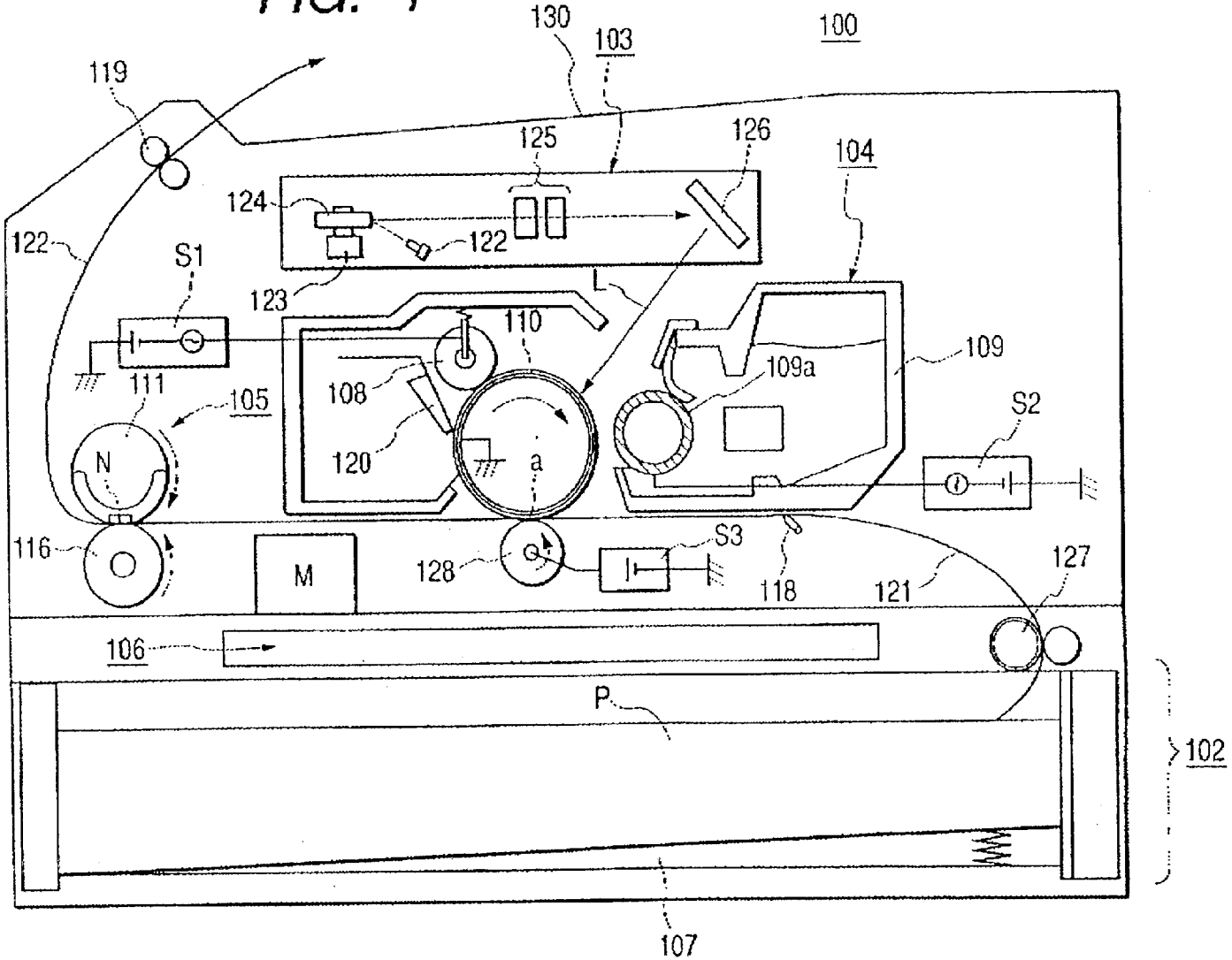
FIG. 1 is a schematic view showing an image forming apparatus according to an embodiment of the present invention.

This laser printer 100 includes a paper feeding cassette 102, a laser scanner unit 103, an image forming unit 104, a fixing unit 105, a control device 106 for controlling sequence of each unit of the printer and so on.

a) Paper Feeding Cassette 102

The paper feeding cassette 102 separates a recording paper P loaded in a paper feeding tray 107 and carries it to a transferring nip part (a) of the image forming unit 104 by using a paper feeding roller 127. Reference numeral 121 denotes a carrying passage reaching from the paper feeding unit 102 to the transferring nip unit (transferring unit) (a), and reference numeral 118 denotes a registration switch installed on the way of this recording paper carrying passage.

b) Laser Scanner Unit 103

The laser scanner unit 103 is a laser light scanning and exposing means for an image forming body of the image forming unit 104, and includes a laser unit 122 to emit light by demodulating the laser light based on the image data provided from an external device, a polygon mirror 124 for scanning the laser light from the laser unit, a motor 123 for driving the polygon mirror to rotate, a textured lens group 125, a reflex mirror 126 and so on.

c) Image Forming Unit 104

The image forming unit 104 includes an electrophotography photosensitive body (hereinafter, referred to as "photosensitive drum") 110 in a rotating drum shape acting as an image forming body, a contact charging roller 108 acting as a charging means, a developing unit 109, a cleaning unit 120 and so on. This image forming unit 104 is configured as a process cartridge, which is detachably changed for the printer main body 100.

The photosensitive drum 110 is driven to rotate to an arrowed clockwise direction on the center of a central axis at a predetermined circumferential speed.

The charging roller 108 is rotatable and contacted to a surface of the photosensitive drum 110 by a predetermined pressure so that a predetermined charging bias is applied to a charging bias applying power source S1. As a result, a circumferential surface of the photosensitive drum 10 is processed to charge electricity in contact identically to predetermined polarity and electrical potential.

The laser light scanning exposure L is fulfilled on the same charging surface of the photosensitive drum 110 by the laser scanner unit 103 so that an electrostatic latent image corresponding to the scanning exposure pattern is formed on the circumferential surface of the photosensitive drum 110.

This electrostatic latent image is developed as a toner image by the developing unit 109. Reference numeral 109*a* denotes a developing sleeve carrying the toner, which is arranged alongside of the photosensitive drum 110, and a predetermined developing bias is applied from a developing bias applying power source S2 thereto.

The toner image formed on the surface of the photosensitive drum 110 is transferred on a surface of the recording paper P fed at predetermined control timing from the paper feeding unit 102 about the transferring nip part (a) between the photosensitive drum 110 and the transferring roller 128 acting as the transferring machine. A predetermined transferring bias is applied to the transferring roller 128 from a transferring bias applying power source S3, and the recording papers P are electrostatically transferred one by one from the surface of the photosensitive drum 110 toward the surface of the recording paper P during being interposed and carried at the transferring nip part (a).

The recording paper P passing the transferring nip part (a) is separated from the surface of the rotating photosensitive drum 110 and carried to the fixing unit 105.

After separating the recording paper, a residual tray is removed from the surface of the photosensitive drum 110 by the cleaning machine 120 so that the photosensitive drum 110 is repeatedly used to form images.

d) Fixing Unit 105

The fixing unit 105 receives the toner image transferred through the transferring nip part (a) and fixes by heat and pressure the toner image on the recording paper P carried and introduced while being separated from the surface of the photosensitive drum 110.

And, the recording paper P on which the toner image is fixed is discharged as an image forming material (for printing or copying) on a discharging tray 130 via a recording paper carrying passage 122 and a discharging roller 119.

e) Control Device 106

The control device 106 controls a sequence of each unit of the above printer.

In this image forming apparatus, the paper feeding roller 127, the photosensitive drum 110 of the image forming unit 104, the charging roller 108, the developing sleeve 109*a*, the transferring roller 128 and the pressing roller 116 and the discharging roller 119 of the fixing unit 105 are all driven by a same main motor M to rotate.

In the present embodiment, a stepping motor is used for the main motor M, and its rotational speed as the recording paper carrying speed may be easily changed by changing a driving pulse frequency. In other words, when elevating a frequency of an exciting pulse generated by the control device 106, the rotational speed of the main motor M is increased and a carrying speed of the recording paper P is increased. On the contrary, if lowering the frequency of the exiting pulse, the rotation of the main motor M becomes slower and the carrying speed of the recording paper P is also delayed. In addition, the speed of the photosensitive drum 110 may also be changed.

(2) Fixing Unit 105

Figure 2:
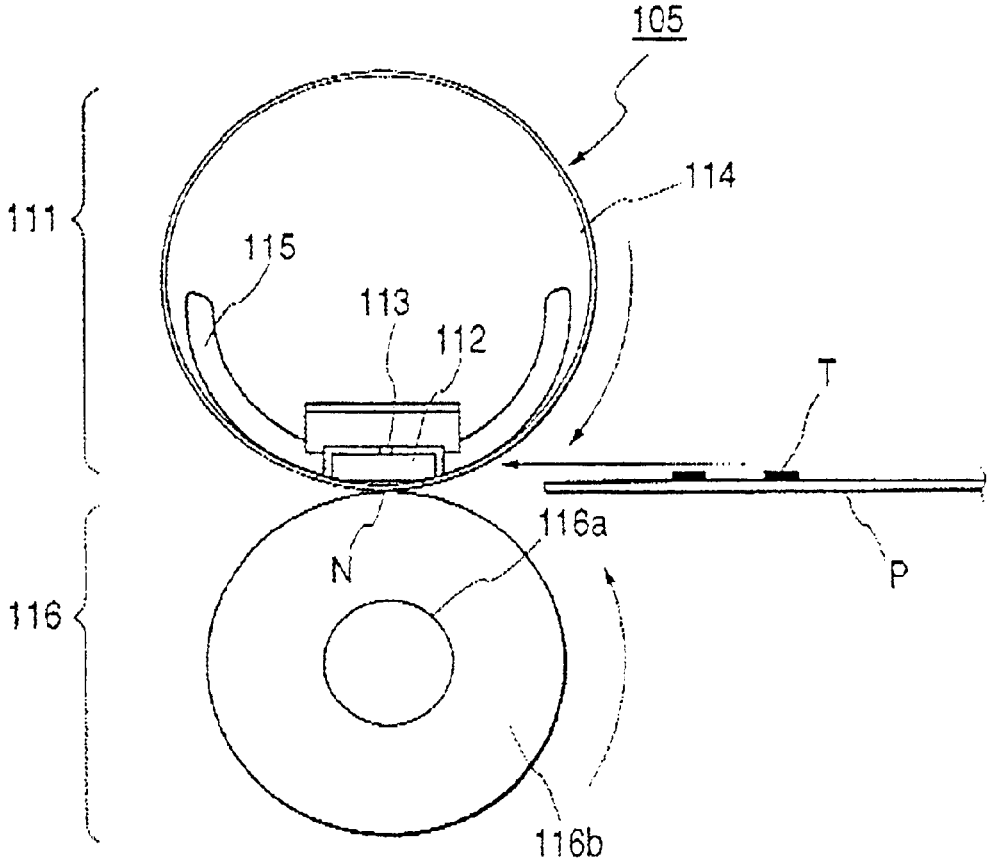
FIG. 2 is a schematic sectional view showing an fixing device.

The fixing unit 105 in this embodiment is a heating and fixing device using a pressing roller driving manner and a film heating manner, disclosed in Japanese Patent Laid-Open NO. 4-44075 to 44083, 204980 to 204984. FIG. 2 is a cross-sectional enlarged schematic view of the fixing unit 105.

This fixing unit 105 includes a heating member 111, which has a heating body 112, a temperature detecting element 113 for detecting temperature of the heating body 112, a heating body support 115 for supporting the heating body 112 and an endless (cylindrical) heat-resisting film 114 mounted to an outside of the heating body support 115 supporting the heating body 112, and pressing rollers 116 acting as a pressing member for pressing the heating body 112 and the heat-resisting film 114 of the heating member 111 in contact to be interposed. A compressed nip part between the heating member 111 and the heating roller 116 is the fixing nip part N.

By installing a driving source to the pressing roller 116 acting as a pressing member to drive the pressing roller 116 for rotation, the endless heat-resisting film 114 acting as a moving body of the heating member 111 is driven to move, and a carrying force is endowed by the rotation force of the pressing roller 36 so that the recording paper P introduced to the fixing nip part N is interposed and carried together with the film 34 at the fixing nip part N. And, by introducing the recording paper P, on which the unfixed toner image T is formed, between the film 114 of the fixing nip part N and the pressing roller 116 to be interposed and carried, the toner image T is melted by the heat of the heating body 112 interposing the film 114 and is so fixed by heat on the surface of the recording material P.

At this time, the film 114 is interposed outside so that the inner circumference has a margin for an outer circumference of the heating body 112 and the heating body support 115. Therefore, the film 114 is guided by the heating body 112 and the heating body support 115 to rotate.

In addition, the film 114 is configured to have a base substance made of polyimide resin of 20 to 100 $\mu$m in thickness and a releasing layer made of a fluoric resin such as PTFE, PFA etc. installed on the base substrate.

The heating body 112 includes an electric resistance layer of 10 $\mu$m in thickness and 1 to 3 mm in width, made of electric resistance materials such as Ag/Pd (silver palladium), a surface of which is processed by such as screen printing, and a protecting layer made of glass or fluoric resin, coated on the electric resistance layer.

The pressing roller 116 includes a core metal 116*a* and a heatproof elastic layer 116*b* installed around the core metal 116*a*. This pressing roller 116 has functions of compressing the recording paper P on the heating body 112 by interposing the film 114 and driving the film 114.

Figure 3:
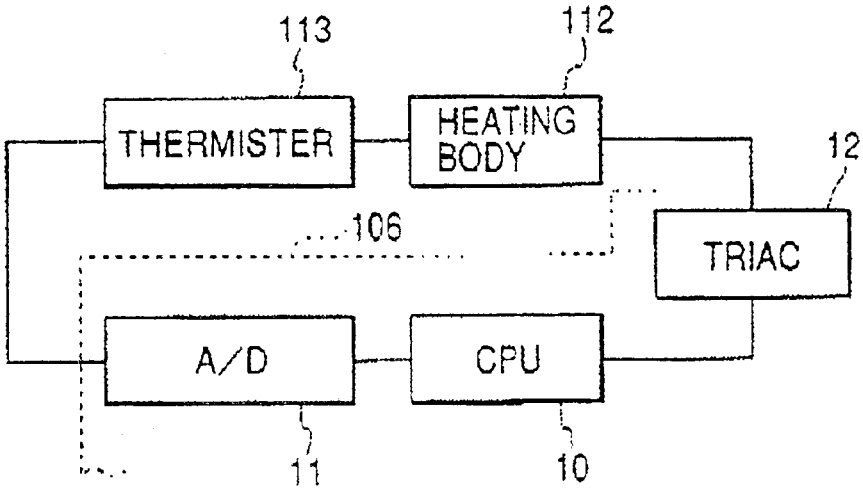
FIG. 3 is a block diagram showing a temperature controller of the image forming apparatus.

A thermistor 113 acting as a temperature detecting means is positioned on a surface of the heating body 112. This thermistor 113 is, as shown in FIG. 3, connected to CPU 10 acting as a temperature controlling means through A/D converter 11. In addition, the CPU 10 controls electricity toward the heating body 112 through a triac 12 (etymologically triode plus A.C.). This electricity control is performed by controlling a higher level or wave number of AC voltage. In other words, the CPU 10 is set to control electricity to the heating body 112 with use of the triac 12 on the basis of a temperature information signal of the heating body 112 output from the thermistor 113 and A/D converted through the A/D converter 11. That is, the CPU 10 controls electricity toward the heating body 112 so that the detected temperature of the thermistor 113 maintains the control temperature.

The A/D converter 11, the CPU 10 and the triac 12 described above are all arranged in the control device 106.

(3) How to Prevent Change of Image Expansion Ratio

Now, described is a reason that elongation of the image, or change of an image expansion ratio is generated.

The change of the image expansion ratio is caused by both of a basic weight of the recording paper P used as a supplied paper and the number of papers on which the images are successively formed.

First, when supplying recording papers P having different weights, carrying speeds of the recording papers are particularly different in the following reasons.

When supplying a recording paper P, of 80 g/m$^2$ for example, because the recording paper is drawn and carried at a recording paper carrying speed at the fixing nip part N while being interposed at the transferring unit (a) after a front end of the recording paper reaches the fixing nip part N of the fixing device 105, the recording paper is carried mainly at the recording paper carrying speed at the fixing nip part N so that the recording paper carrying speed is principally dominated by the recording paper carrying speed at the fixing nip part N.

In case of supplying a recording paper P having a greater basic weight of 126 g/m$^2$ in the same size, the recording paper is more strongly interposed at the transferring unit (a) than the recording paper of 80 g/m$^2$, because it is thicker than the recording paper of 80 g/m$^2$, and while being drawn in the recording paper carrying speed at the fixing nip part N, it is carried more slowly than the 80 g/m$^2$ recording paper.

In addition, in case of performing successive image forming, because the pressing roller 116 of the fixing device 105 is heated by the heating member 111 to gradually increase its outer circumference, the recording paper carrying speed at the fixing nip part N is increased little by little, so causing speed changing phenomenon when the recording paper carrying speed is increased.

For that reason, the change of the image expansion ratio is generated due to both the basic weight of the recording paper P and the successive image forming number.

Therefore, in the present embodiment, an initial rotational speed of the main motor M is determined (see FIG. 1) based on "a plurality of fixing modes set corresponding to a basic weight of the recording paper P used as a supplied paper" and furthermore main motor M is controlled by decreasing the rotational speed of the main motor M step by step according to the successive image forming number of each fixing mode.

Therefore, the rotational speed is slowed down in consideration of both the change of the image expansion ratio according to the difference of the basic weight of the recording paper P used as a supplied paper and the image expansion ratio caused by the thermal expansion of the pressing roller 116.

The image forming apparatus of this embodiment has three kinds of fixing modes: "a light media mode", "a normal mode", "a rough media mode", each of which is corresponding to a recording paper of less than 64 g/m$^2$, a recording paper of 64 to 90 g/m$^2$ and a recording paper of more than 90 g/m$^2$.

The CPU 10 determines the fixing mode according to the kind information of the used recording paper, input from an external device, a recording paper selecting means or a kind detecting means detecting the kind of the supplied recording paper. Table 1 shows control temperatures of the fixing device 105 in each mode. As shown in the table, the control temperature of the fixing device 105 is set higher for a recording paper having greater basic weight so as to obtain equal fixing property to other recording papers having different basic weights. In addition, as the successive print sheet number increases, the control temperature is lowered to obtain stable fixing property.

TABLE 1

| Number of printed papers | Control temperature of fixing device (° C.) | | |
|---|---|---|---|
| | Light media mode | Normal mode | Rough media mode |
| 1 to 10 | 190 | 195 | 200 |
| 11 to 50 | 185 | 190 | 195 |
| 51 to | 180 | 185 | 190 |

Because the basic weight information of the paper is reflected on the fixing mode as above, the paper carrying speed is changed based on the fixing mode when printing.

Figure 4:
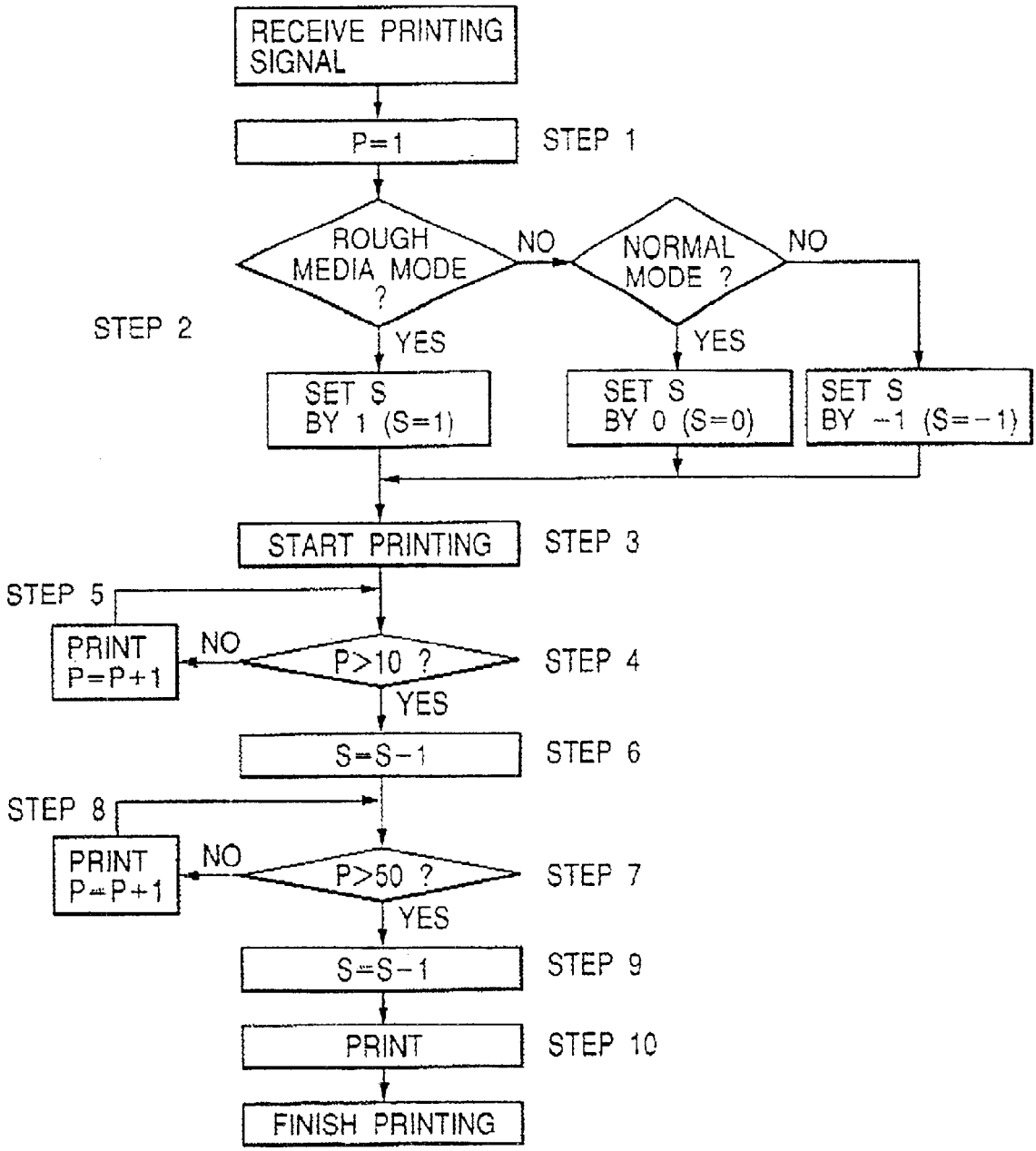
FIG. 4 is a flowchart for illustrating the controlling.

FIG. 4 is a flowchart for illustrating the above controlling of the present embodiment. In the figure, P denotes a value of a print sheet number counter which is calculated by the CPU 10 of the control unit 106, and S denotes a recording paper carrying speed level, specifically indicated by a value as shown in Table 2.

TABLE 2

| Speed level S | Carrying speed (Level 0 = 100%) | Motor rotational speed[rpm] |
|---|---|---|
| Level 1 | 100.5% | 1125.6 |
| Level 0 | 100.0% | 1120 |
| Level −1 | 99.5% | 1114.4 |
| Level −2 | 99.0% | 1108.8 |
| Level −3 | 99.0% | 1103.2 |

The image forming apparatus of this embodiment is operated as below according to the flowchart shown in FIG. 4.

After receiving a printing signal, the value of the print sheet number counter P is reset to 1 (step 1).

Then, a recording paper carrying speed at the first to tenth sheets (initial speed) is determined by the fixing mode in the step 2.

For example, if the fixing mode determined by the CPU 10 before forming images is the rough media mode, which is "Y (YES)" in the divergence of determining whether or not the rough media mode in the flowchart, the speed level S is set to "1" and the motor rotational speed at this time becomes 1125.6 rpm according to the table 2.

In addition, if the fixing mode is the normal mode, which is "N (NO)" in the divergence of determining whether or not the rough media mode, it progresses to the divergence of determining whether or not the normal mode. Because it is "Y" in the divergence of determining whether or not the normal mode, the speed level S is set to "0" and the motor rotational speed at this time becomes 1120 rpm according to the table 2.

In addition, if the fixing mode is the light media mode, which is "N" in both the divergence of determining whether or not the rough media mode and the divergence of determining whether or not the normal mode, it is determined to be the remaining light media mode among three kinds of the modes included in the image forming apparatus so that the speed level S is set to "−1" and the motor rotational speed at this time becomes 1108.8 rpm according to the table 2.

If the initial speed is determined in the step 2, the printing is started (step 3).

If the printing starts, it is determined whether the print sheet number counter exceeds 10, and if it does not exceed 10, the printing is performed by maintaining the speed level initially set in step 2, and "1" is added to the sheet number counter P (step 5) and returns to step 4.

On the other hand, if the print sheet number counter exceeds 10, "1" is subtracted from the speed level S so as to set the recording paper carrying speed as much as one level.

For example, in case of the rough media mode, though the speed level S is set to "1" (1125.6 rpm) when the print sheet number counter P is 10, if the successive print sheet number becomes 11, the paper carrying speed level when printing the eleventh sheet and over becomes "0", reduced as much as one level, and the motor rotating speed is set to 1120 rpm.

Then, in the step 7, it is determined whether the print sheet number counter exceeds 50, similarly to step 4, and if not exceeding 50, the recording paper is carried and printed while maintaining the speed level set in step 6, and "1" is added to the sheet number counter P (step 8) and returns to step 7.

If the print sheet number counter is exceeding 50 in the step 7, the paper carrying speed level is reset to a value, which is additionally subtracted as much as one level (step 9), and the printing is continued (step 10).

Figure 5:
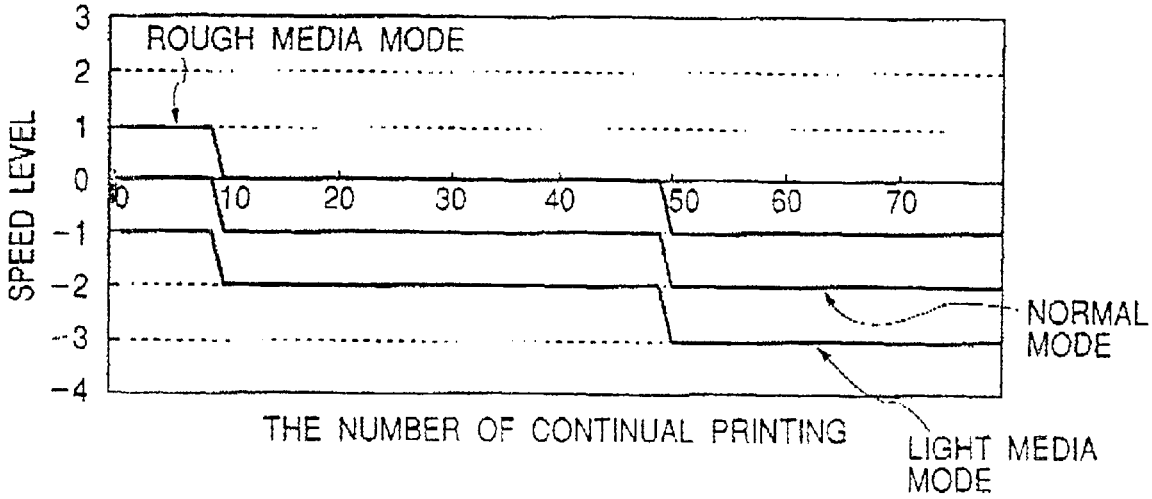
FIG. 5 shows a change of speed level of each fixing mode depending on the successive printing paper number based on the controlling of the present invention.

The speed levels and changed states at each fixing mode for the successive print sheet number based on the controlling are shown in FIG. 5.

If the rotational speed of the main motor M is slowed down, each rotating circumferential speed of the paper feeding roller 127, the photosensitive drum 110, the transferring roller 111, and the pressing roller 116 and the discharging roller 119 of the fixing device 105 constituting the recording paper carrying passages 121 and 122 from the paper feeding roller 127 to the discharging roller 119 is also slowed down rather than a common rotating circumferential speed so that the recording paper carrying speed is slowed down rather than a common carrying speed.

And, because the rotating circumferential speed of the photosensitive drum 10 is decreased than a common rotating circumferential speed for the latent image forming speed by the laser scanner unit 122, the latent image and the toner image formed on the photosensitive drum 110 is formed contracted to a rotation direction of the photosensitive drum as much as a proportion corresponding to a slowdown amount of the rotating circumferential speed of the photosensitive drum 110.

Though slowing down the recording paper carrying speed by controlling the main motor M, the recording paper carrying speed at the fixing nip part N of the fixing device 105 during successive printing is still higher than the recording paper carrying speed at the transferring unit (a) because the diameter of the pressing roller 116 is increased due to the thermal expansion, and the recording paper P is drawn and carried at the transferring unit (a).

For that reason, the toner image which is formed contracted on the surface of the photosensitive drum 110 in a photosensitive drum rotating direction is transferred to the recording paper P while being elongated in a recording paper carrying direction for the recording paper surface, and is subsequently drawn and carried by the transferring unit (a).

That is, in the successive printing, the main motor M is controlled to slow down the recording paper carrying speed at a suitable proportion in correspondence with the increase of the recording paper carrying speed at the fixing nip part N due to the outer circumference increase caused by the thermal expansion of the pressing roller 116 of the fixing device 105 at the 11th sheet and the 51st sheet, as shown in the flowchart of FIG. 4, so that the contracted amount of the toner image contractedly formed on the surface of the photosensitive drum 110 and the image elongated amount at the transferring are offset by each other, resulting that a toner image with the contraction and elongation compensated is transferred and formed on the surface of the recording paper.

In this embodiment, the switching of the recording paper carrying speed is performed during not forming the image, that is while the laser unit 122 in the laser scanner unit 103 does not emit light.

Figure 6:
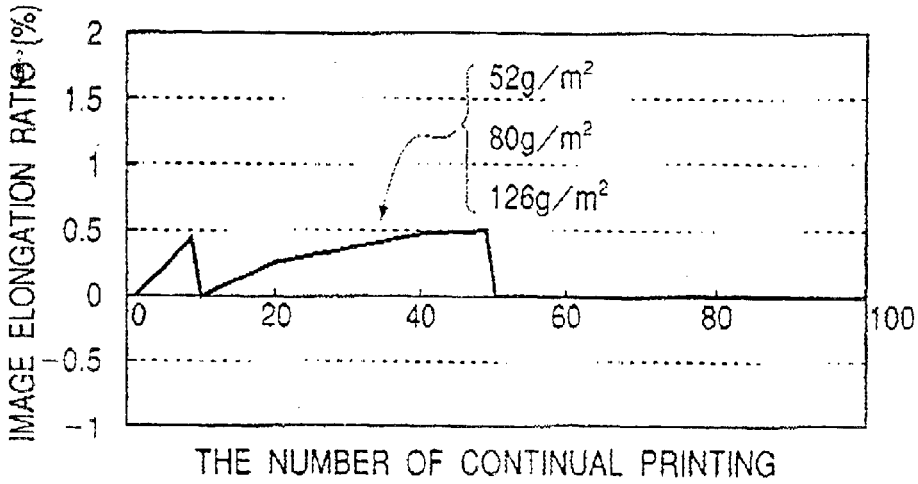
FIG. 6 shows a change of the image elongation ratio depending on the printing paper number when successively forming the images in the image forming apparatus according to the embodiment of the present invention.

The change of the image expansion (elongation) ratio for the image forming sheet number when the successive image forming is performed using a high quality paper of 52 g/m$^2$, 80 g/m$^2$ and 126 g/m$^2$ with the image forming apparatus of this embodiment in real is shown in FIG. 6. The image expansion (elongation) ratio is set so that an image length on the recording paper at the first sheet of the paper 80 g/m$^2$ is 100%, and indicates how much percentage % of the image is elongated or contracted.

Figure 7:
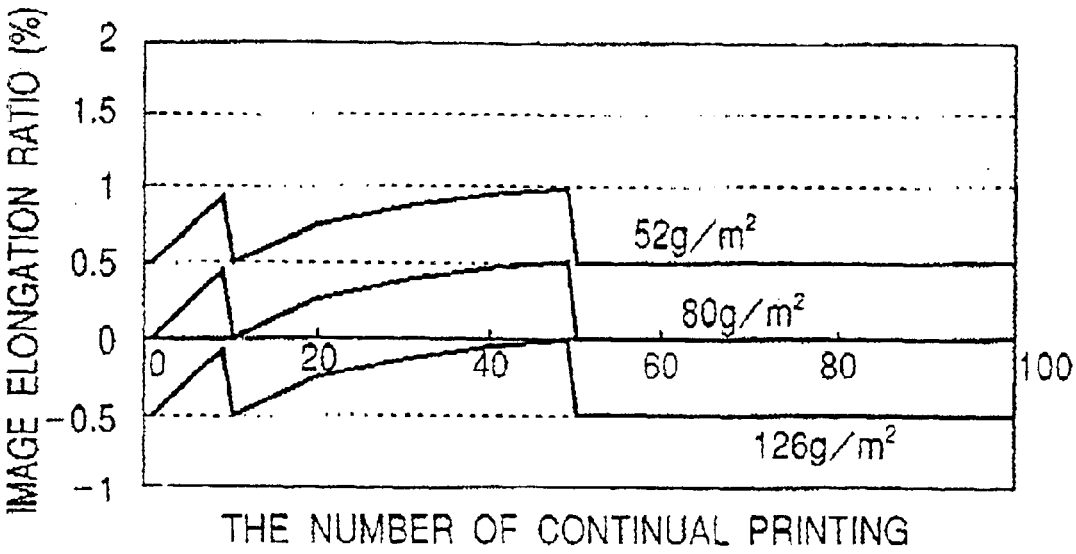
FIG. 7 shows a change of the image elongation ratio depending on the printing paper number when successively forming the images in a conventional image forming apparatus.
Figure 8:
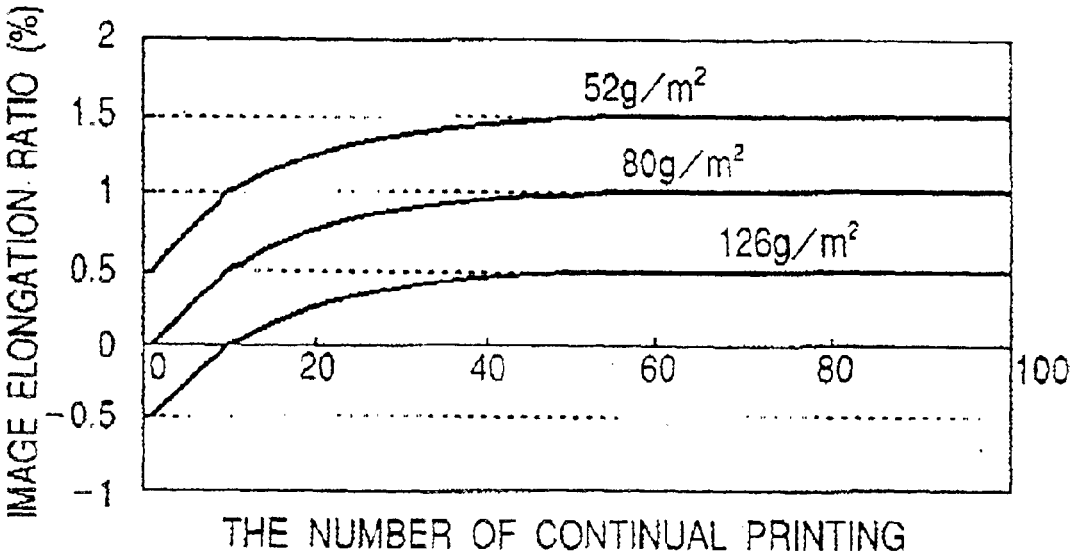
FIG. 8 shows a change of the image elongation ratio depending on the printing paper number when successively forming the images in case that the recording paper carrying speed is fixed in a conventional image forming apparatus.
Figure 9:
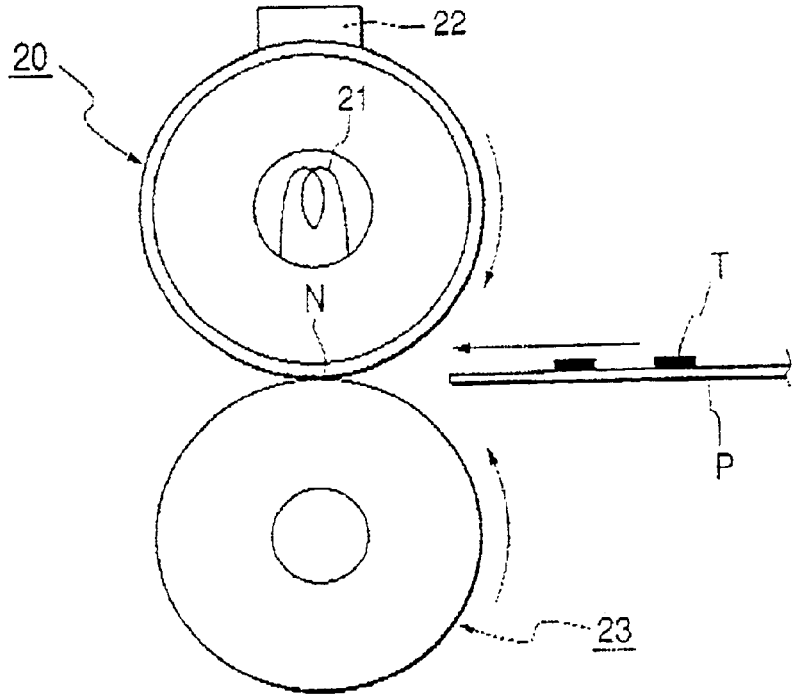
FIG. 9 is a schematic view showing a conventional heat-fixing device using the heat roller manner.
Figure 10:
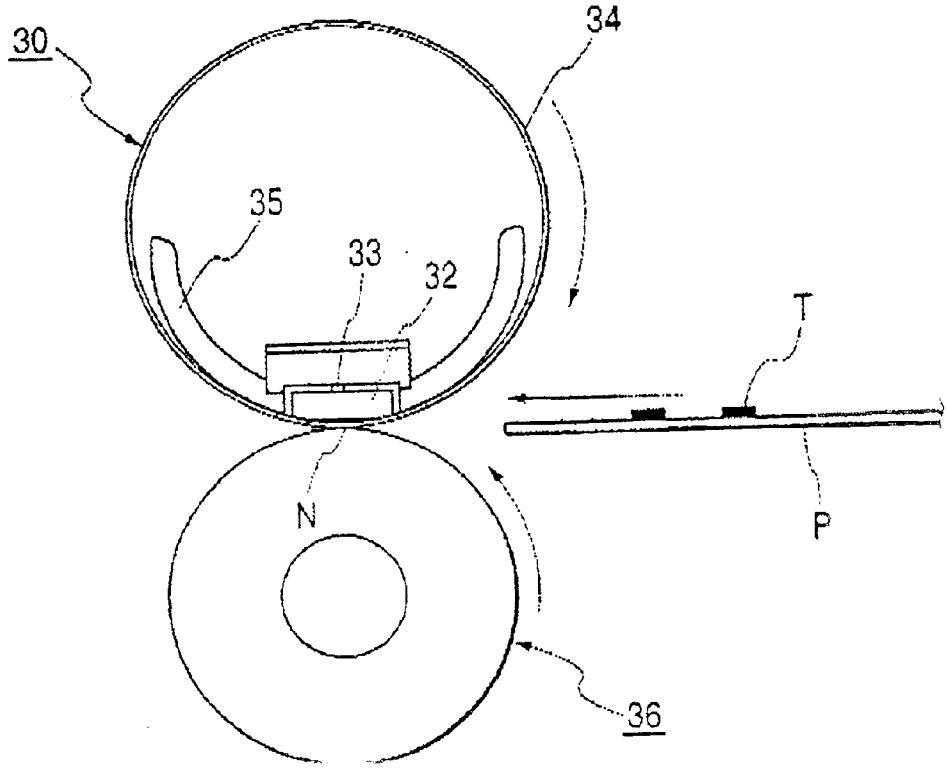
FIG. 10 is a schematic sectional view showing a conventional heat-fixing device using the film heating manner.

FIG. 8 shows the change of the image extension ratio when not changing the recording paper carrying speed, while FIG. 7 shows the change of the image extension ratio when changing the recording paper carrying speed based on only the successive image forming sheet number, conventionally.

In case of not changing the recording paper carrying speed as shown in FIG. 8, the image extension ratio of the recording paper having each basic weight is changed over the range of −0.5% and 1.5% because each recording paper generates image extension.

On the other hand, in case of changing the recording paper carrying speed based on only the successive image forming sheet number conventionally as shown in FIG. 7, though a range of change of the image extension ratio is reduced in the recording paper having the same basic weight, the image extension ratio change on overall supplied recording paper is ranged from −0.5% and 1.0%.

As for this, the image forming apparatus of this embodiment shown in FIG. 6 switches the recording paper carrying speed based on the basic weight of the recording paper and the successive image forming sheet number, so restraining the change of image extension ratio within 0.5%, and it would be understood that the change range of image extension ratio is reduced, compared with the conventional art.

As a result, in the image forming apparatus having the fixing device 105 using a manner of driving the pressing roller 116, it becomes possible to dramatically restrict the change range of image extension ratio by changing the moving speed of the photosensitive drum according to the kind of fixing mode paper.

Though the recording paper carrying speed is changed to be in accord with the switching sheet number of the control temperature of the fixing device 105 in this embodiment, the switching sheet number of the control temperature of the fixing device 105 and the sheet number of changing the recording paper carrying speed are not necessarily identical.

In addition, the change of the image elongation and contraction ratio can be more decreased by setting the switching range of the recording paper carrying speed more minutely and increasing the number of speed levels.

In the present invention, the fixing device is not limited to the film heating manner, if it just uses a manner of driving the pressing member in contact with the heating member to be rotated, and a heater roller manner can be used, and an electromagnetic induction manner may be used as a heating method. The present invention is not limited to the above cases, but includes modifications within the technical scope.

What is claimed is:

1. An image forming apparatus comprising:

an image bearing member;

transferring means for transferring an image formed on said image bearing member to a recording material;

fixing means for fixing by heat the image transferred on the recording material to the recording material, said fixing means including a pressing roller to carry the recording material; and speed setting means for setting a moving speed of said image bearing member based on a kind of the recording material and information indicative of a circumferential length of said pressing roller, wherein said speed setting means sets to a slow speed when a basic weight of the recording material is low and the information indicative of the circumferential length is within a predetermined level.

2. An image forming apparatus according to claim 1, wherein said apparatus further includes writing means for writing an image on said image bearing member, and wherein said image bearing member is changed to a speed set by said speed setting means when said writing means does not write the image on said image bearing member.

3. An image forming apparatus according to claim 1, wherein said apparatus further includes a driving motor for driving said image bearing member, and wherein said driving motor also drives said pressing roller.

4. An image forming apparatus according to claim 3, wherein, when the speed of said image bearing member changes, the speed of said pressing roller changes.

5. An image forming apparatus according to claim 1, wherein the information indicative of the circumferential length is a successive print sheet number.

6. An image forming apparatus according to claim 1, wherein said transferring means includes a transferring member bringing the recording material in contact with said image bearing member.

7. An image forming apparatus according to claim 1, wherein a distance between a transferring position and a fixing position is shorter than a length of the recording material of a maximum size usable in said apparatus.

8. An image forming apparatus according to claim 1, wherein said pressing roller has an elastic layer.

9. An image forming apparatus comprising:

an image bearing member;

transferring means for transferring an image formed on said image bearing member to a recording material;

fixing means for fixing by heat the image transferred on the recording material to the recording material, said fixing means including a pressing roller to carry the recording material; and speed setting means for setting a moving speed of said image bearing member based on a kind of the recording material and information indicative of a circumferential length of said pressing roller, wherein said speed setting means sets the moving speed of said image bearing member to a slow speed when a basic weight of the recording material is low and the information indicative of the circumferential length is large.

10. An image forming apparatus comprising:

an image bearing member;

transferring means for transferring an image formed on said image bearing member to a recording material at a transferring nip portion; and fixing means for fixing by heat the image transferred on the recording material to the recording material at a fixing nip portion, said fixing means including an elastic roller for forming the fixing nip portion, wherein the recording material comes into the fixing nip portion before transferring of the image at the transferring nip portion completes, and wherein, during formation of an image on said image bearing member, a moving speed of said image bearing member is slower when a recording material is used that has a basic weight that is a first value than a moving speed of said image bearing member when a second recording material is used that has a basic weight that is a second value greater than the first value.

11. An image forming apparatus according to claim 10, wherein a moving speed of said image bearing member when a circumferential length of said elastic roller is a second length is slower than a moving speed of said image bearing member when the circumferential length of said elastic roller is a first length, which is shorter than the second length.

12. An image forming apparatus according to claim 10, further comprising a driving motor for driving said image bearing member and said elastic roller, wherein a rotational speed of each of said image bearing member and said elastic roller is simultaneously switched by switching a driving speed of said driving motor.

13. An image forming apparatus comprising:

an image bearing member;

writing means for writing an image on said image bearing member;

transferring means for transferring the image formed on said image bearing member to a recording material at a transferring nip portion;

fixing means for fixing by heat the image transferred on the recording material to the recording material at a fixing nip portion, said fixing means including an elastic roller for forming the fixing nip portion;

a first driving motor for driving said writing means; and a second driving motor for driving said image bearing member and said elastic roller;

wherein the recording material comes into the fixing nip portion before transferring of the image at the transferring nip portion completes, and wherein, during formation of an image on said image bearing member, a magnification of an image written on said image bearing member by said writing means varies in a moving direction of said image bearing member by varying a rotational speed of said second driving motor to a rotational speed of said first driving motor according to a kind of the recording material.

14. An image forming apparatus according to claim 13, wherein, in a moving direction of said image bearing member, a magnification of an image formed on said image bearing member at a time when the driving speed of said second driving motor is a first speed is smaller than a magnification of an image formed on said image bearing member at a time when the driving speed of said second driving motor is a second speed faster than the first speed.

15. An image forming apparatus according to claim 14, wherein when said elastic roller is thermally expanded, the recording material on both said transferring means and said fixing means is pulled by said elastic roller, and an image transferred from said image bearing member to the recording material is magnified in a moving direction of the recording material by a difference of speeds of said image bearing member and the recording material.

* * * * *

UNITED STATES PATENT AND TRADEMARK OFFICE

CERTIFICATE OF CORRECTION

PATENT NO. : 6,885,832 B2
DATED : April 26, 2005
INVENTOR(S) : Hikaru Osada

It is certified that error appears in the above-identified patent and that said Letters Patent is hereby corrected as shown below:

Title page,
Item [56], References Cited, FOREIGN PATENT DOCUMENTS, “07325442 A” should read -- 7-325442 A --.
Item [57], ABSTRACT,
Line 10, “than” should read -- with respect to --.

Column 1,
Line 54, “surface” should read -- surface. --.

Column 2,
Line 18, “rapid” shoud read -- rapidly --.
Line 20, “of” should be deleted.
Line 21, “as” should be deleted.
Line 45, “than” should read -- with respect to --.

Column 4,
Line 14, “manner,” should read -- manner; --.

Column 6,
Line 2, “NO.” should read -- No. --.

Column 8,
Lines 51, 59 and 67, “table 2.” should read -- Table 2. --.

Column 10,
Line 19, “in real” should be deleted.
Line 41, “and” should read -- to --.

UNITED STATES PATENT AND TRADEMARK OFFICE

CERTIFICATE OF CORRECTION

PATENT NO. : 6,885,832 B2
DATED : April 26, 2005
INVENTOR(S) : Hikaru Osada

It is certified that error appears in the above-identified patent and that said Letters Patent is hereby corrected as shown below:

Column 12,
Lines 15 and 54, “completes,” should read -- is completed, --.

Signed and Sealed this

Twenty-second Day of November, 2005

JON W. DUDAS
*Director of the United States Patent and Trademark Office*